US007737376B2

(12) United States Patent
Sydorenko et al.

(10) Patent No.: US 7,737,376 B2
(45) Date of Patent: Jun. 15, 2010

(54) MECHANICAL SWITCH

(75) Inventors: Oleksandr Sydorenko, Painted Post, NY (US); Nikolai Zhitenev, Berkeley Heights, NJ (US)

(73) Assignee: Alcatel-Lucent USA Inc., Murray Hill, NJ (US)

( * ) Notice: Subject to any disclaimer, the term of this patent is extended or adjusted under 35 U.S.C. 154(b) by 620 days.

(21) Appl. No.: 11/801,329

(22) Filed: May 9, 2007

(65) Prior Publication Data

US 2008/0277252 A1 Nov. 13, 2008

(51) Int. Cl.
*H01H 57/00* (2006.01)

(52) U.S. Cl. ..... 200/181; 335/78

(58) Field of Classification Search ..... 200/181; 335/78

See application file for complete search history.

(56) References Cited

U.S. PATENT DOCUMENTS

| | | | | |
|---|---|---|---|---|
| 6,372,820 | B1 | 4/2002 | Devonport | 523/215 |
| 7,026,014 | B2 | 4/2006 | Luzinov et al. | 427/402 |
| 7,049,904 | B2 * | 5/2006 | Shin | 333/105 |
| 7,052,616 | B2 * | 5/2006 | Fonash et al. | 216/2 |
| 7,125,938 | B2 | 10/2006 | Matyjaszewski et al. | 526/147 |
| 2002/0100870 | A1 * | 8/2002 | Whitehouse et al. | 250/281 |
| 2003/0040173 | A1 * | 2/2003 | Fonash et al. | 438/622 |
| 2004/0180465 | A1 * | 9/2004 | Musolf et al. | 438/52 |
| 2005/0012562 | A1 * | 1/2005 | Shin | 333/105 |
| 2005/0032203 | A1 * | 2/2005 | Beck et al. | 435/287.2 |
| 2005/0242339 | A1 * | 11/2005 | Beck | 257/4 |
| 2006/0066423 | A1 * | 3/2006 | Greywall et al. | 335/78 |
| 2006/0094198 | A1 * | 5/2006 | Klauk et al. | 438/382 |
| 2006/0183262 | A1 * | 8/2006 | Freidhoff | 438/48 |
| 2007/0117244 | A1 * | 5/2007 | Chen et al. | 438/50 |
| 2007/0215866 | A1 * | 9/2007 | Getty et al. | 257/40 |
| 2008/0067555 | A1 * | 3/2008 | Beebe et al. | 257/212 |
| 2008/0079029 | A1 * | 4/2008 | Williams | 257/213 |
| 2008/0090337 | A1 * | 4/2008 | Williams | 438/133 |
| 2008/0179696 | A1 * | 7/2008 | Chen et al. | 257/415 |
| 2009/0136181 | A1 * | 5/2009 | Vollmer et al. | 385/50 |
| 2009/0242875 | A1 * | 10/2009 | Zhitenev | 257/40 |

FOREIGN PATENT DOCUMENTS

DE 10225313 A1 1/2004

(Continued)

OTHER PUBLICATIONS

U.S. Appl. No. 11/514,483, filed Sep. 1, 2006, Oleksandr Sydorenko et al.

(Continued)

*Primary Examiner*—Michael A Friedhofer
(74) *Attorney, Agent, or Firm*—The Law Office of J.M. Brown

(57) ABSTRACT

Apparatus including a substrate and a mechanical switch, the mechanical switch located over the substrate, the mechanical switch including: a first electrical contact over the substrate; a support over the substrate, the support including a region moveable relative to the first electrical contact, the moveable region having a second electrical contact, the second electrical contact located over the first electrical contact; and a self-assembled molecular layer between the substrate and the second electrical contact. Method including placing into operation an apparatus, and applying a coulomb force causing the second electrical contact to move relative to the first electrical contact such that the switch is opened or closed.

20 Claims, 6 Drawing Sheets

FOREIGN PATENT DOCUMENTS

| | | | |
|---|---|---|---|
| EP | 1557396 | A2 | 7/2005 |
| WO | WO03/101628 | A1 | 12/2003 |

OTHER PUBLICATIONS

"Ordered Reactive Nanomembranes / Nanotemplates from Thin Films of Block Copolymer Supramolecular Assembly," Oleksandr Sydorenko, Igor Tokarev, Sergiy Minko, and Manfred Stamm, *J. Am. Chem. Soc.*, 125 (40), 12211-12216 (2003).

"Microphase Separation in Thin Films of Poly(styrene-block-4-vinylpyridine) Copolymer-2-(4'-Hydroxybenzeneazo)benzoic Acid Assembly," Igor Tokarev, Radim Krenek, Yevgen Burkov, Dieter Schmeisser, Oleksander Sydorenko, Sergiy Minko, and Manfred Stamm, *Macromolecules*, 38 (2), 507-516 (2005); web release date Dec. 16, 2004.

* cited by examiner

MECHANICAL SWITCH

BACKGROUND OF THE INVENTION

1. Field of the Invention

This invention generally relates to mechanical switches and to methods for controlling a mechanical switch in an electrical circuit.

2. Related Art

Various types of mechanical switches have been developed. Further, myriad miniaturized electronic components have been developed for integration into an integrated circuit. There is a continuing need for miniaturized mechanical switches and for methods for controlling a mechanical switch in an electrical circuit.

SUMMARY

In an example of an implementation, an apparatus is provided that includes a substrate and a mechanical switch, the mechanical switch located over the substrate, the mechanical switch including: a first electrical contact over the substrate; a support over the substrate, the support including a region moveable relative to the first electrical contact, the moveable region having a second electrical contact, the second electrical contact located over the first electrical contact; and a self-assembled molecular layer between the substrate and the second electrical contact.

As another example of an implementation, a method is provided that includes placing into operation an apparatus having a first electrical contact and a support including a region moveable relative to the first electrical contact, the moveable region having a second electrical contact, the second electrical contact located over the first electrical contact, and the apparatus having a self-assembled molecular layer interposed between the first and second electrical contacts; and applying a coulomb force causing the second electrical contact to move relative to the first electrical contact such that the switch is opened or closed.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention can be better understood with reference to the following figures. The components in the figures are not necessarily to scale, emphasis instead being placed upon illustrating the principles of the invention. Moreover, in the figures, like reference numerals designate corresponding parts throughout the different views.

DETAILED DESCRIPTION

An apparatus is provided that includes a substrate and a mechanical switch. The mechanical switch is located over the substrate. The mechanical switch includes a first electrical contact over the substrate. The mechanical switch further includes a support over the substrate, the support including a region moveable relative to the first electrical contact. The moveable region has a second electrical contact. The second electrical contact is located over the first electrical contact. A self-assembled molecular layer is interposed between the first and second electrical contacts. The mechanical switch may, for example, include an electrical contact configured to apply a coulomb force capable of moving the second electrical contact relative to the first electrical contact such that the switch is opened or closed. In another example, the moveable region may locate the second electrical contact at a position spaced apart from the first electrical contact.

Figure 1:
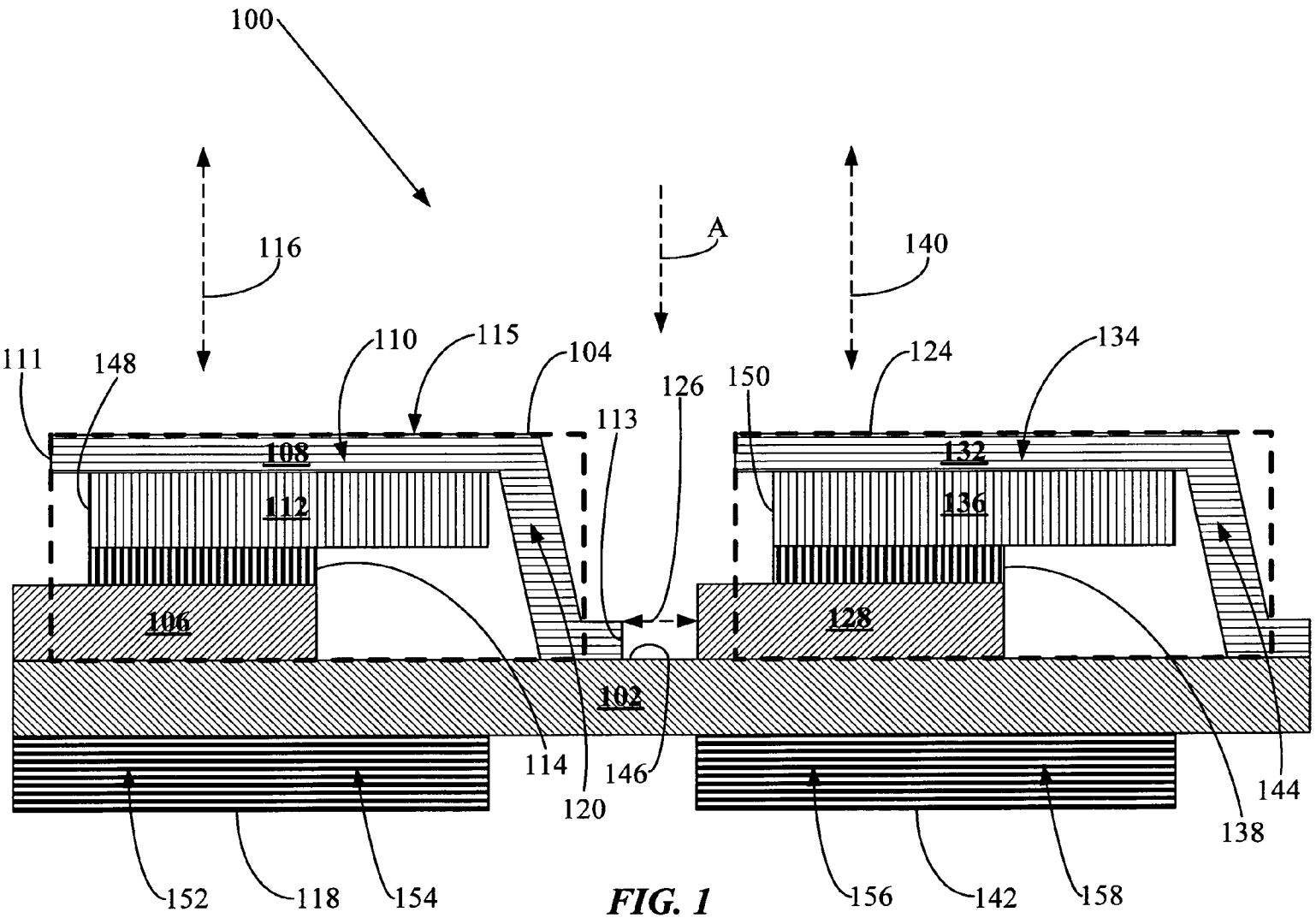
FIG. 1 is a cross-sectional side view showing an example of an implementation of an apparatus.

FIG. 1 is a cross-sectional side view showing an example of an implementation of an apparatus 100. The apparatus 100 includes a substrate 102, and a mechanical switch 104 indicated by a dotted line box. The mechanical switch 104 is located over the substrate 102. The mechanical switch 104 includes a first electrical contact 106 over the substrate 102. The mechanical switch 104 further includes a support 108 over the substrate 102, the support 108 including a region 110 moveable relative to the first electrical contact 106. As an example, the support 108 may include an arm as shown in FIG. 1. An arm may include first and second ends 111, 113 respectively, spaced apart by an elongated region 115. The moveable region 110 has a second electrical contact 112. The second electrical contact 112 is located over the first electrical contact 106. The mechanical switch 104 additionally includes a self-assembled molecular layer ("SAM") 114 interposed between the first and second electrical contacts 106 and 112. It is understood by those skilled in the art that a self-assembled molecular layer as referred to throughout this specification may include, fixed on a surface, a monolayer of molecules having two spaced-apart ends separated by an elongated region. Each molecule of the self-assembled molecular layer may have one of its ends chemically attached, e.g. covalently bonded, to the surface. Each molecule of the self-assembled molecular layer may have another of its ends unattached to the surface, leaving the elongated region and the unattached end free to move relative to other chemically fixed molecules of the self-assembled molecular layer, as by bending.

The first and second electrical contacts 106 and 112 may be, in an example, configured to together form a controllable electrical pathway in an electrical circuit (not shown). The moveable region 110 may be caused to move along a general direction of the arrow 116 relative to and toward the substrate 102. Upon sufficient displacement of the self-assembled molecular layer 114, an electrical connection may be completed such that the mechanical switch 104 is placed in a switch-closed state, closing an external circuit (not shown) of which the first and second electrical contacts 106 and 112 form a part of the electrical path. As another example, the apparatus 100 may include an electrical contact 118 configured to apply a coulomb force to the mechanical switch 104 capable of moving the second electrical contact 112 toward the first electrical contact 106 such that the switch is closed. Further according to such an example, the moveable region 110 of the mechanical switch 104 may locate the second electrical contact 112 in a switch-open state at a position spaced apart from the first electrical contact 106. In addition to the moveable region 110, the support 108 of the mechanical switch 104 may include a flexible region 120. The flexible region 120 of the support 108 may facilitate movement of the moveable region 110 along directions of the arrow 116. It is understood that the location of the flexible region 120 shown in FIG. 1 is merely an example, and that an apparatus 100 may include one or more flexible regions (not shown) at other selected regions of the support 108.

A device may be formed, for example, including two or more mechanical switches 104 on the substrate 102. As an example, the apparatus 100 may include a second mechanical switch 124 indicated by a dotted line box, spaced apart at a lateral distance 126 from the mechanical switch 104. The mechanical switch 104 may be referred to as the first mechanical switch. The second mechanical switch 124 may also be located over the substrate 102. The second mechanical switch 124 includes a third electrical contact 128 over the substrate 102. The second mechanical switch 124 further includes a second support 132 over the substrate 102, the second support 132 including a second region 134 moveable relative to the third electrical contact 128. As an example, the support 132 may include an arm as shown in FIG. 1. The second moveable region 134 has a fourth electrical contact 136. The fourth electrical contact 136 is located over the third electrical contact 128. The second mechanical switch 124 additionally includes a self-assembled molecular layer 138 interposed between the third and fourth electrical contacts 128 and 136. In another example, features of apparatus 300, 500 discussed below in connection with FIGS. 3-4, 5 may be included in the apparatus 100. The entirety of the discussions below of apparatus 300, 500 are incorporated in this discussion of the apparatus 100.

The third and fourth electrical contacts 128 and 136 may be, in an example, configured to together form a controllable electrical pathway in an electrical circuit (not shown). The second moveable region 134 may be caused to move along a general direction of the arrow 140 relative to and toward the substrate 102. Upon sufficient displacement of the self-assembled molecular layer 138, an electrical connection may be completed such that the mechanical switch 124 is placed in a switch-closed state, closing an external circuit (not shown) of which the third and fourth electrical contacts 128, 136 form part of the electrical path. As another example, the apparatus 100 may include an electrical contact 142 configured to apply a coulomb force to the second mechanical switch 124 capable of moving the fourth electrical contact 136 toward the third electrical contact 128 such that the switch is closed. Further according to such an example, the second moveable region 134 of the second mechanical switch 124 may locate the fourth electrical contact 136 in a switch-open state at a position spaced apart from the third electrical contact 128. In addition to the second moveable region 134, the second support 132 of the second mechanical switch 124 may include a second flexible region 144. The second flexible region 144 of the second support 132 may facilitate movement of the second moveable region 134 along directions of the arrow 140. It is understood that the location of the second moveable region 134 shown in FIG. 1 is merely an example, and that the second mechanical switch 124 may include one or more flexible regions (not shown) at other selected regions of the second support 132.

An apparatus 100 including a plurality of mechanical switches 104, 124 formed on the substrate 102 may, as examples, constitute part of an integrated circuit (not shown) or of a micro-electro-mechanical system ("MEMS") (not shown), or of a semiconductor device (not shown), or of a sensor (not shown), or of a filter (not shown), or of another electronic circuit (not shown). A MEMS may include mechanical elements, actuators for the mechanical elements, and electronics for controlling the actuators. A MEMS device may include sensors. A MEMS device may further include optical elements, such as mirrors controlled by the actuators. The term "semiconductor device" as used throughout this specification includes, as examples, transistors such as field effect transistors ("FETs") and other types of transistors, diodes, and other semiconductor devices that may or may not utilize a doped semiconductor p-n hetero-junction between Group 3-5, 2-6, or 4-4 semiconductors allowing a controlled flow of electrons and/or holes across the hetero-junction.

As another example, a plurality of mechanical switches 104, 124 may be formed in a laterally spaced-apart arrangement on the substrate 102. The lateral spaced-apart arrangement may be, as examples, a uniform array or an arrangement forming parts of an integrated circuit, MEMS, semiconductor device, sensor, filter, or another electronic circuit. The lateral distance 126 between any two mechanical switches 104, 124 may be determined consistent, for example, with a design for an integrated circuit, MEMS, semiconductor device, sensor, filter, or another electronic circuit, and may vary accordingly.

It is understood by those skilled in the art that the apparatus 100 as shown in FIG. 1 may be oriented in any direction. For example, upon orienting the apparatus 100 upside-down from its position shown in FIG. 1, it is understood that the electrical contacts 106, 112, 128, 136 and the supports 108, 132 each remain "over" the substrate 102. It is further understood that the electrical contacts 106, 112, 128, 136 and the supports 108, 132 each remain "over" the substrate 102 regardless of the interposition of additional elements of the apparatus 100 (not shown) between the substrate 102 and any or each of the electrical contacts 106, 112, 128, 136 and the supports 108, 132.

Figure 2:
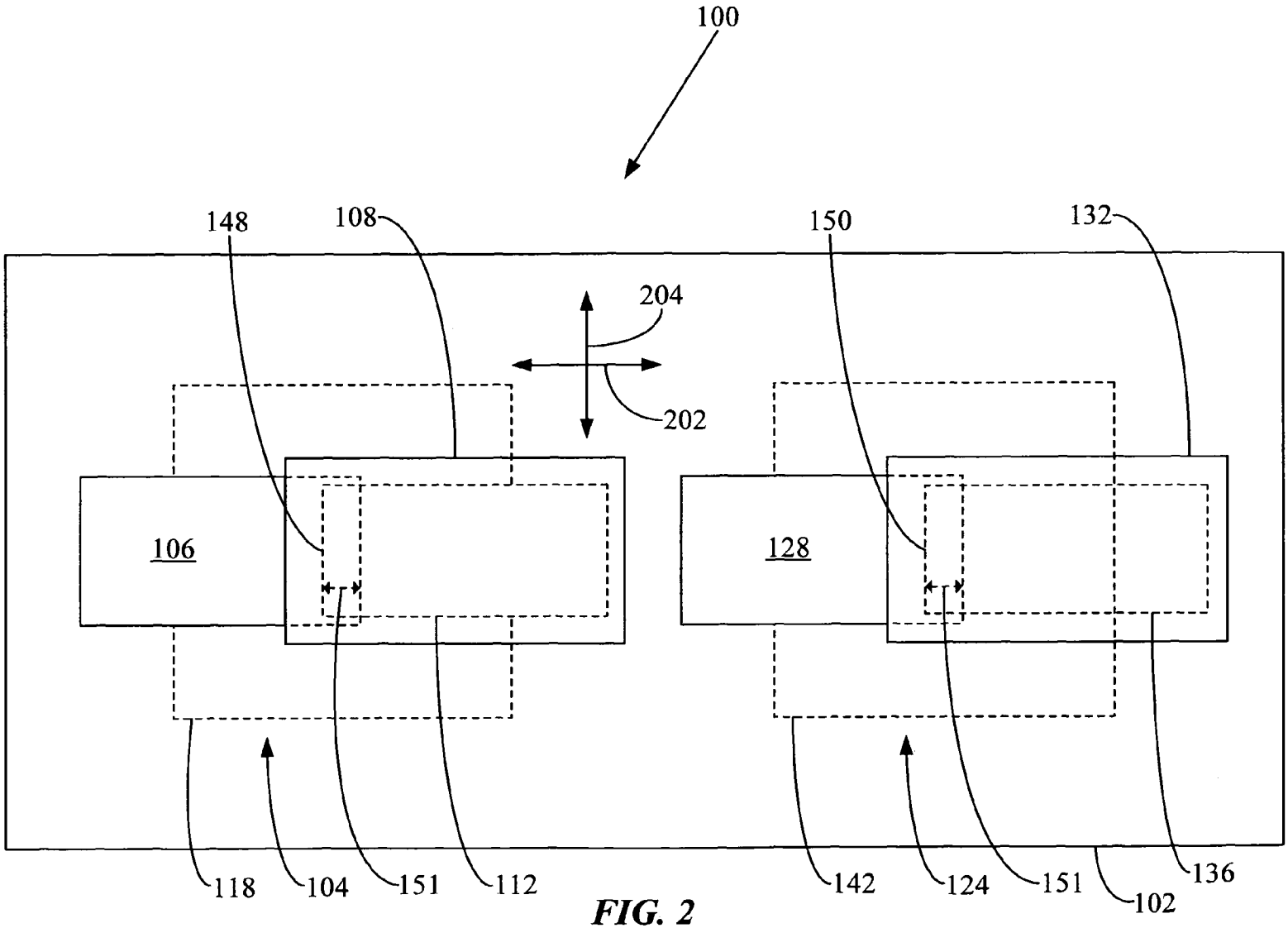
FIG. 2 is a top view, taken in the direction of the arrow A, of the apparatus shown in FIG. 1.

FIG. 2 is a top view, taken in the direction of the arrow A, of the apparatus 100 shown in FIG. 1. As an example, the apparatus 100 may include mechanical switches 104, 124 over a substrate 102. The mechanical switches 104, 124 may respectively include supports 108, 132. The mechanical switch 104 may include first and second electrical contacts 106, 112 located between the substrate 102 and the support 108. The second mechanical switch 124 may include third and fourth electrical contacts 128, 136 located between the substrate 102 and the support 132. The mechanical switches 104, 124 may, for example, respectively include electrical contacts 118, 142. The electrical contact 118 may include a contact part 152 aligned along directions of the arrow 116 with the first and second electrical contacts 106, 112; and a contact part 154 aligned along directions of the arrow 116 with only the second electrical contact 112. The electrical contact 142 may include a contact part 156 aligned along directions of the arrow 140 with the third and fourth electrical contacts 128, 136; and a contact part 158 aligned along directions of the arrow 140 with only the fourth electrical contact 136. The contact parts 154, 158 may respectively facilitate application of a coulomb force to the second and fourth electrical contacts 112, 136. The contact parts 152, 156 may be shielded by the first and third electrical contacts 106, 128 from the second and fourth electrical contacts 112, 136 along directions of the arrows 116, 140. Overall dimensions of each mechanical switch 104, 124 in the directions of the arrows 202, 204 may be selected to be sufficiently large to facilitate fabrication of the mechanical switches 104, 124 and their connection into external circuits (not shown). Overall dimensions of each mechanical switch 104, 124 in the directions of the arrows 202, 204 may be minimized so as to maximize a quantity of mechanical switches 104, 124 that may be formed on a surface 146 of the substrate 102. As examples, the dimensions of each mechanical switch 104, 124 in the directions of the arrows 202, 204 may be within ranges of between about 10 nanometers and about 2 microns. The supports 108, 132 may, for example, be longer in the directions of the arrow 202 than the corresponding second electrical contact 112 and fourth electrical contact 136. The relatively greater lengths of the supports 108, 132 than the electrical contacts 112, 136 in this example may facilitate flexing of the supports 108, 132 in the directions of the arrows 116, 140.

As a further example, formation of an electrically-conductive connection between the first and second electrical contacts 106, 112 and between the third and fourth electrical contacts 128, 136 may be facilitated by positioning the second and fourth electrical contacts 112, 136 to only partially overlap from a perspective taken in the directions of the arrows 116, 140 with the first and third electrical contacts 106, 128 along edges 148, 150 of the second and fourth electrical contacts 112, 136, respectively. In an example, lengths of the edges 148, 150 in the directions of the arrow 204 may be within a range of between about 10 nanometers and about 2 microns. As another example, a width 151 defined in the directions of the arrow 202 of a part of the second and fourth electrical contacts 112, 136 that overlaps from a perspective taken in the directions of the arrows 116, 140 with the first and third electrical contacts 106, 128 respectively may be selected. The overlap width 151 may need to be adequately large to provide a low resistance pathway for a DC current between the first and second electrical contacts 106, 112 when the mechanical switch 104 is closed. The overlap width 151 may also need to be adequately large to provide a low resistance pathway between the third and fourth electrical contacts 128, 136 when the mechanical switch 124 is closed. The overlap width 151 may also be selected to avoid excessive overlap, to minimize potential electrical short circuiting between the respective electrical contacts through defects in the self-assembled molecular layer 114, 138. For example, a width 151 defined in directions of the arrow 202 of a part of the second and fourth electrical contacts 112, 136 that overlap from a perspective taken in the directions of the arrows 116, 140 with the first and third electrical contacts 106, 128 respectively may be less than about one micron, or within a range of between about 100 nanometers and about 300 nanometers, or less than about 200 nanometers.

Figure 3:
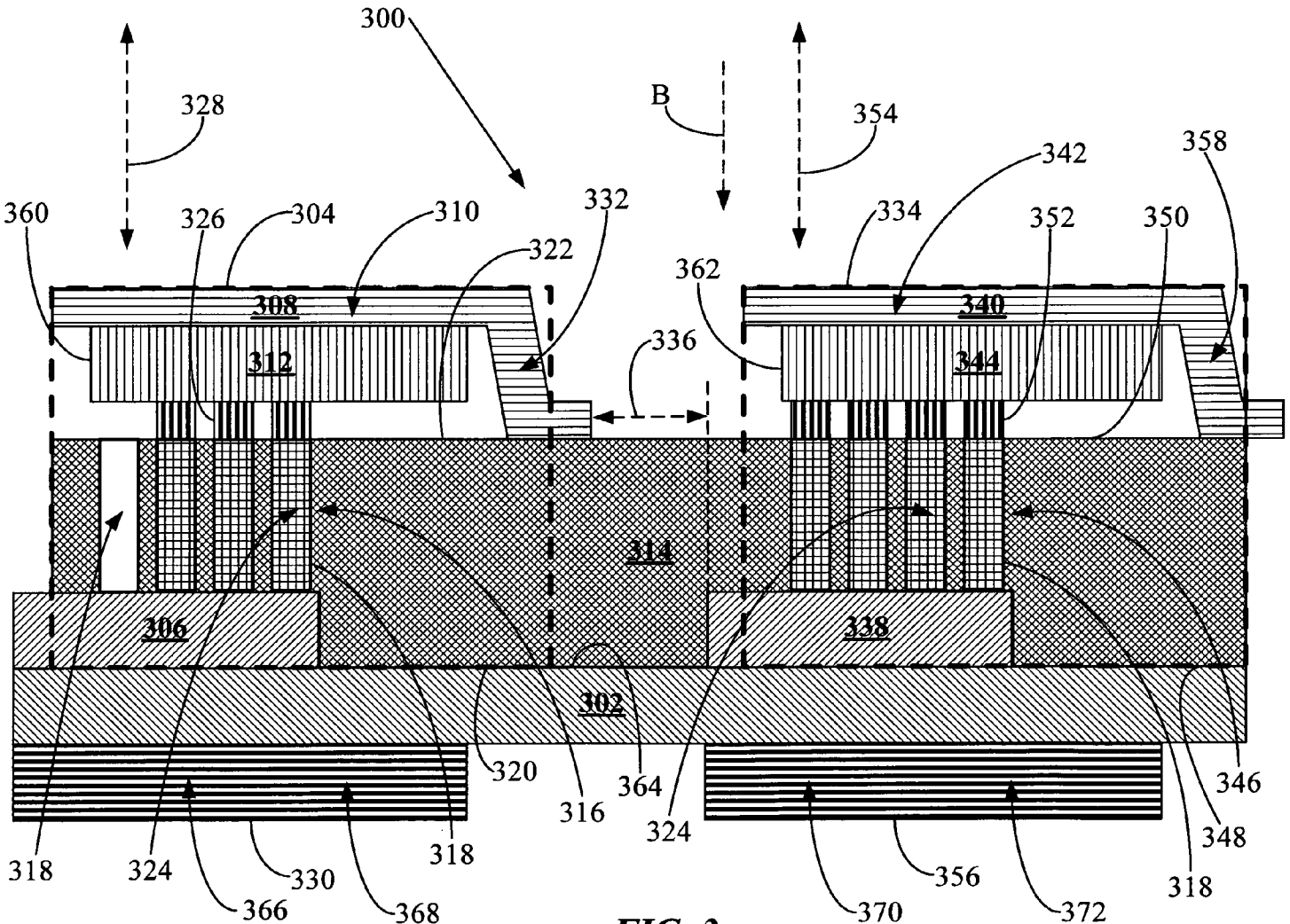
FIG. 3 is a cross-sectional side view showing an example of another implementation of an apparatus.

FIG. 3 is a cross-sectional side view showing an example of another implementation of an apparatus 300. The apparatus 300 includes a substrate 302, and a mechanical switch 304 indicated by a dotted line box. The mechanical switch 304 is located over the substrate 302. The mechanical switch 304 includes a first electrical contact 306 over the substrate 302. The mechanical switch 304 further includes a support 308 over the substrate 302, the support 308 including a region 310 moveable relative to the first electrical contact 306. As an example, the support 308 may include an arm as shown in FIG. 3. The moveable region 310 has a second electrical contact 312. The second electrical contact 312 is located over the first electrical contact 306. The apparatus 300 additionally includes a dielectric layer 314. A part 316 of the dielectric layer 314 is interposed between the substrate 302 and the support 308. The dielectric layer 314 has a hole 318 aligned between the first and second electrical contacts 306, 312. As an example, the dielectric layer 314 may have a first surface 320 facing the first electrical contact 306, a second surface 322 facing the second electrical contact 312, and a hole 318 between the first and second electrical contacts 306, 312 and communicating between the first and second surfaces 320, 322. In an example, the hole 318 may be a pore 318. As a further example, the hole 318 may have an electrically-conductive filling 324. An electrically-conductive filling 324 may include, for example, particles having a composition including one or more metals such as gold, silver, platinum, palladium, copper, nickel and chromium. In a further example, the electrically-conductive filling 324 may include, for example, particles having a composition including an electrically-conductive polymeric composition such as polythiophene, polyaniline, or poly(3,4-ethylenedioxy-thiophene):poly(styrenesulfonate), (also referred to as "PEDOT:PSS"). The mechanical switch 304 additionally includes a self-assembled molecular layer 326 interposed between the dielectric layer 314 and the second electrical contact 312. As an example, the self-assembled molecular layer 326 may be located between the second electrical contact 312 and an electrically-conductive filling 324 in a pore 318. In another example, features of apparatus 100 discussed above in connection with FIGS. 1-2 or of apparatus 500 discussed below in connection with FIG. 5 may be included in the apparatus 300. The entireties of the discussions of apparatus 100, 500 are incorporated in this discussion of the apparatus 300.

The first and second electrical contacts 306 and 312 may be, in an example, configured to together form a controllable electrical pathway in an electrical circuit (not shown). The moveable region 310 may be caused to move along a general direction of the arrow 328 relative to and toward the substrate 302. Upon sufficient displacement of the self-assembled molecular layer 326, an electrical connection may be completed such that the mechanical switch 304 is placed in a switch-closed state, closing an external circuit (not shown) of which the first and second electrical contacts 306 and 312 form part of the electrical path. As another example, the apparatus 300 may include an electrical contact 330 configured to apply a coulomb force to the mechanical switch 304 capable of moving the second electrical contact 312 toward the first electrical contact 306 such that the switch is closed. Further according to such an example, the moveable region 310 of the mechanical switch 304 may locate the second electrical contact 312 in a switch-open state at a position spaced apart from the dielectric layer 314. In addition to the moveable region 310, the support 308 of the mechanical switch 304 may include a flexible region 332. The flexible region 332 of the support 308 may facilitate movement of the moveable region 310 along directions of the arrow 328. It is understood that the location of the flexible region 332 shown in FIG. 3 is merely an example, and that an apparatus 300 may include one or more flexible regions (not shown) at other selected regions of the support 308.

An apparatus 300 may, for example, include a plurality of mechanical switches such as mechanical switch 304 on the substrate 302. For example, a plurality of mechanical switches including the mechanical switch 304 and a second mechanical switch 334 may be located in a laterally spaced-apart arrangement on the substrate 302. Such a plurality of mechanical switches 304, 334 formed on the substrate 302 may, in examples, constitute components of an integrated circuit (not shown) or of a micro-electronic-mechanical system ("MEMS") (not shown), or of a semiconductor device (not shown), or of a sensor (not shown), or of a filter (not shown), or of another electronic circuit (not shown).

As an example, the apparatus 300 may include a second mechanical switch 334 indicated by a dotted line box, spaced apart at a lateral distance, indicated by the arrow 336, from the mechanical switch 304. The mechanical switch 304 may be referred to as the first mechanical switch. The second mechanical switch 334 includes a third electrical contact 338 over the substrate 302. The second mechanical switch 334 further includes a second support 340 over the substrate 302, the second support 340 including a second region 342 moveable relative to the third electrical contact 338. As an example, the support 340 may include an arm as shown in FIG. 3. The second moveable region 342 has a fourth electrical contact 344. The fourth electrical contact 344 is located over the third electrical contact 338. A part 346 of the dielectric layer 314 is interposed between the substrate 302 and the second support 340. The dielectric layer 314 has a hole 318 aligned between the third and fourth electrical contacts 338, 344. As an example, the dielectric layer 314 may have a first surface 348 facing the third electrical contact 338, a second surface 350 facing the fourth electrical contact 344, and a hole 318 interposed between the third and fourth electrical contacts 338, 344 and communicating between the first and second surfaces 348, 350. In an example, the hole 318 may be a pore 318. As a further example, the hole 318 may have an electrically-conductive filling 324. An electrically-conductive filling 324 may include, for example, particles having a composition including one or more metals such as gold, silver, platinum, palladium, copper, nickel and chromium; or a conductive polymeric composition as discussed earlier. The mechanical switch 334 additionally includes a self-assembled molecular layer 352 interposed between the dielectric layer 314 and the fourth electrical contact 344. As an example, the self-assembled molecular layer 352 may be between the fourth electrical contact 344 and an electrically-conductive filling 324 in a pore 318.

The third and fourth electrical contacts 338 and 344 may be, in an example, configured to together form a controllable electrical pathway in an electrical circuit (not shown). The second moveable region 342 may be caused to move along a general direction of the arrow 354 relative to and toward the substrate 302. Upon sufficient displacement of the self-assembled molecular layer 352, an electrical connection may be completed such that the mechanical switch 334 is placed in a switch-closed state, closing an external circuit (not shown) of which the third and fourth electrical contacts 338 and 344 form a part of the electrical path. As another example, the apparatus 300 may include an electrical contact 356 configured to apply a coulomb force to the second mechanical switch 334 capable of moving the fourth electrical contact 344 toward the third electrical contact 338 such that the switch is closed. Further according to such an example, the second moveable region 342 of the second mechanical switch 334 may locate the fourth electrical contact 344 in a switch-open state at a position spaced apart from the dielectric layer 314. In addition to the moveable region 342, the second support 340 of the second mechanical switch 334 may include a flexible region 358. The flexible region 358 of the second support 340 may facilitate movement of the second moveable region 342 along directions of the arrow 354. It is understood that the location of the flexible region 358 shown in FIG. 3 is merely an example, and that an apparatus 300 may include one or more flexible regions (not shown) at other selected regions of the second support 340. As an example, the dielectric layer 314 may be flexible, to facilitate movement of the support 308, 340 in directions of the arrows 328, 354.

It is understood by those skilled in the art that the apparatus 300 as shown in FIG. 3 may be oriented in any direction. For example, upon orienting the apparatus 300 upside-down from its position shown in FIG. 3, it is understood that the first, second, third and fourth electrical contacts 306, 312, 338 and 344, and the support and second support 308, 340, each remain "over" the substrate 302. It is further understood that the first, second, third and fourth electrical contacts 306, 312, 338 and 344, and the support and second support 308, 340, each remain "over" the substrate 302 regardless of the interposition of additional elements of the apparatus 300 (not shown) between the substrate 302 and any or each of the first, second, third and fourth electrical contacts 306, 312, 338 and 344, and the support and second support 308, 340.

Figure 4:
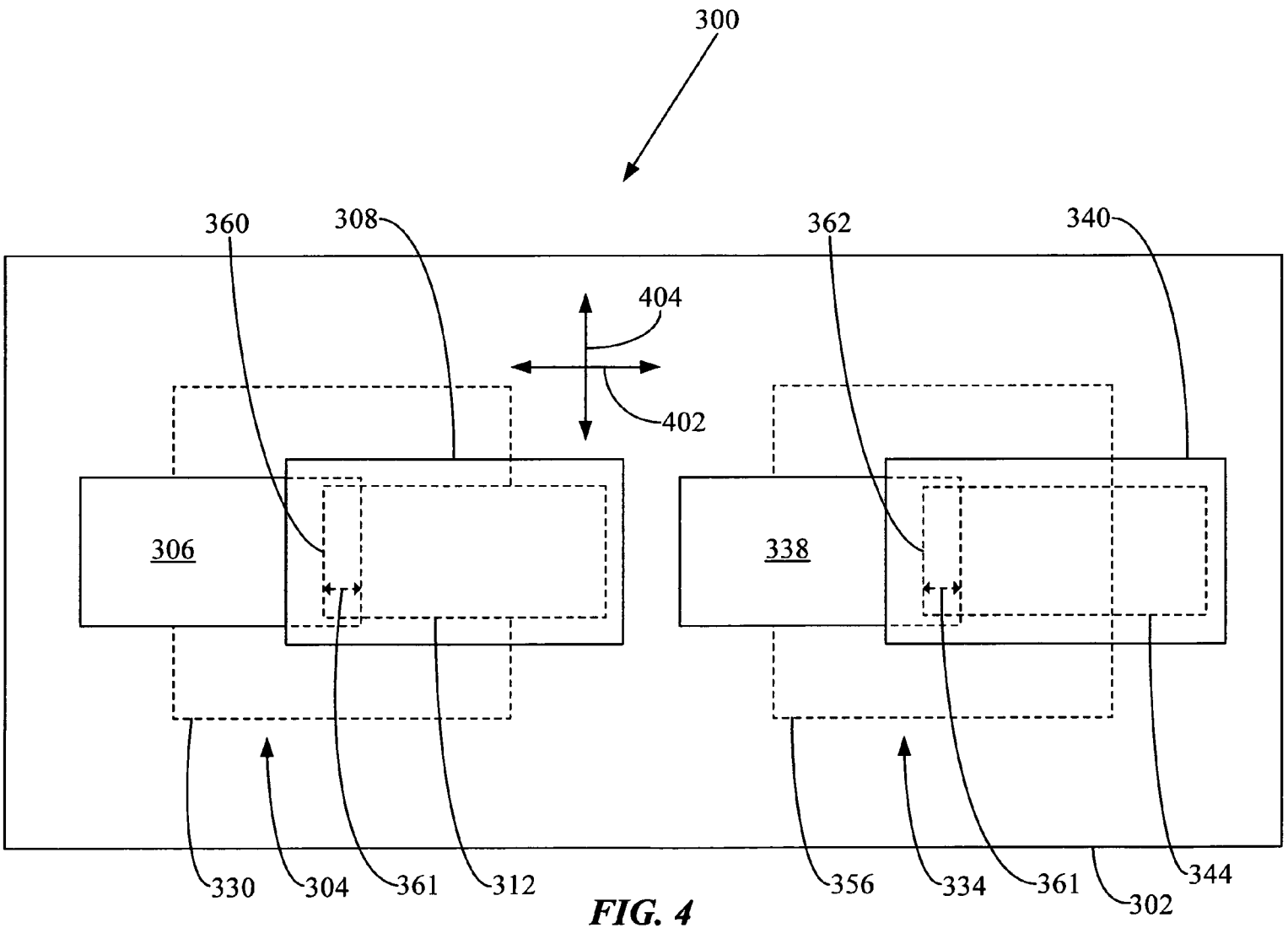
FIG. 4 is a top view, taken in the direction of the arrow B, of the apparatus shown in FIG. 3.

FIG. 4 is a top view, taken in the direction of the arrow B, of the apparatus 300 shown in FIG. 3. As an example, the apparatus 300 may include mechanical switches 304, 334 over a substrate 302. The mechanical switches 304, 334 may respectively include supports 308, 340. The mechanical switch 304 may include first and second electrical contacts 306, 312 located between the substrate 302 and the support 308. The second mechanical switch 334 may include third and fourth electrical contacts 338, 344 located between the substrate 302 and the second support 340. The mechanical switches 304, 334 may, for example, respectively include electrical contacts 330, 356. The electrical contact 330 may include a contact part 366 aligned along directions of the arrow 328 with the first and second electrical contacts 306, 312; and a contact part 368 aligned along directions of the arrow 328 with only the second electrical contact 312. The electrical contact 356 may include a contact part 370 aligned along directions of the arrow 354 with the third and fourth electrical contacts 338, 344; and a contact part 372 aligned along directions of the arrow 354 with only the fourth electrical contact 344. The contact parts 368, 372 may respectively facilitate application of a coulomb force to the second and fourth electrical contacts 312, 344. The contact parts 366, 370 may be shielded by the first and third electrical contacts 306, 338 respectively from the second and fourth electrical contacts 312, 344 along directions of the arrows 328, 354. Overall dimensions of each mechanical switch 304, 334 in the directions of the arrows 402, 404 may be selected to be sufficiently large to facilitate fabrication of the mechanical switches 304, 334 and their connection into external circuits (not shown). Overall lateral linear dimensions of each mechanical switch 304, 334 in the directions of the arrows 402, 404 may be minimized so as to maximize a quantity of mechanical switches 304, 334 that may be formed on the substrate 302. As examples, the dimensions of each mechanical switch 304, 334 in the directions of the arrows 402, 404 may be within ranges of between about 10 nanometers and about 2 microns. The supports 308, 340 may, for example, be longer in the directions of the arrow 402 than the corresponding second electrical contact 312 and fourth electrical contact 344. The relatively greater lengths of the supports 308, 340 than the electrical contacts 312, 344 in this example may facilitate flexing of the supports 308, 340 in the directions of the arrows 328, 354.

As a further example, formation of an electrically-conductive connection between the first and second electrical contacts 306, 312 and between the third and fourth electrical contacts 338, 344 may be facilitated by positioning the second and fourth electrical contacts 312, 344 to only partially overlap from a perspective taken in the directions of the arrows 328, 354 with the first and third electrical contacts 306, 338 along edges 360, 362 of the second and fourth electrical contacts 312, 344, respectively. In an example, lengths of the edges 360, 362 in the directions of the arrow 404 may be within a range of between about 10 nanometers and about 2 microns. As another example, a width 361 defined in the directions of the arrow 402 of a part of the second and fourth electrical contacts 312, 344 that overlaps from a perspective taken in the directions of the arrows 328, 354 with the first and third electrical contacts 306, 338 may be selected. The overlap width 361 may need to be adequately large to provide a low resistance pathway for electrical currents through the dielectric layer 314 between the first and second electrical contacts 306, 312 and between the third and fourth electrical contacts 338, 344. The overlap width 361 may also be selected to avoid excessive overlap, to minimize potential electrical short circuiting between the respective electrical contacts through defects in the dielectric layer 314. For example, a width 361 defined in the directions of the arrow 402 of a part of the second and fourth electrical contacts 312, 344 that overlap from a perspective taken in the directions of the arrows 328, 354 with the first and third electrical contacts 306, 338 may be less than about one micron, or within a range of between about 100 nanometers and about 300 nanometers, or less than about 200 nanometers.

In an example, the substrate 102, 302 may have a thickness in the directions of the arrows 116, 140, 328, 354 that is sufficiently large to provide structural integrity to the apparatus 100, 300 and that is not excessively large beyond a reasonable thickness needed for such integrity. For example, the substrate 102, 302 may have a thickness in the directions of the arrows 116, 140, 328, 354 within a range of between about 10 nanometers and about 500 nanometers. The electrical contacts 106, 112, 118, 128, 136, 142, 306, 312, 330, 338, 344, 356 may have thicknesses in the directions of the arrows 116, 140, 328, 354 that are sufficiently large to conduct an electrical current compatible with an external circuit (not shown), and that are not larger than may be needed to conduct such an electrical current. For example, the electrical contacts 106, 112, 118, 128, 136, 142, 306, 312, 330, 338, 344, 356 may have thicknesses in the directions of the arrows 116, 140, 328, 354 within a range of between about 5 nanometers and about 100 nanometers. The supports 108, 132, 308, 340 may have thicknesses in the directions of the arrows 116, 140, 328, 354 that are sufficiently large to provide structural integrity to the apparatus 100, 300 through repeated cycles of moving the moveable regions of the supports 108, 132, 308, 340 toward the electrical contacts 106, 128, 306, 338 without damage, and that are not so large as to prevent such repeated movement of the moveable regions of the supports 108, 132, 308, 340 toward the electrical contacts 106, 128, 306, 338. For example, the supports 108, 132, 308, 340 may have thicknesses in the directions of the arrows 116, 140, 328, 354 within a range of between about 5 nanometers and about 50 nanometers.

The electrical contacts 106, 112, 118, 128, 136, 142, 306, 312, 330, 338, 344, 356 may be formed, as examples, from an electrically-conductive composition including one or more metals such as gold, silver, platinum, palladium, copper, nickel and chromium. In further examples, the electrical contacts 106, 112, 118, 128, 136, 142, 306, 312, 330, 338, 344, 356 may be formed from an electrically-conductive polymeric composition such as poly(3,4-ethylenedioxythiophene): poly(styrenesulfonate), (also referred to as "PEDOT:PSS"). The substrates 102, 302 provide physical support to the apparatus 100, 300. The substrates 102, 302 may include a crystalline semiconductor such as conventional $p^+$-doped, $n^-$-doped, or undoped crystalline silicon; or a conventional dielectric composition including a silica glass. The substrates 102, 302 may include multiple layers of dielectric and/or semiconductor materials. The supports 108, 132, 308, 340 may be formed, as examples, from a dielectric material. In further examples, the supports 108, 132, 308, 340 may be formed from a flexible dielectric material such as a polyester, polyolefin, or polyamide. The supports 108, 132, 308, 340 may also be formed of an electrically-conductive composition.

The electrically-conductive filling 324 generally may be formed of any electrically-conductive composition capable of being selectively deposited into the holes 318. As an example, the electrically-conductive filling 324 may include particles having a composition including a metal or a conductive polymer. For example, such particles may include nano-crystals formed of an electrically-conductive composition. The nano-crystals may be aggregated in clusters. As an example, the electrically-conductive filling 324 may protrude from the pores 318 in a direction along the arrows 328, 354 toward the second and fourth electrical contacts 312, 344.

The self-assembled molecular layers 114, 138, 326, 352 may generally be formed from molecules suitable for forming an electrically non-conducting passivation layer. As an example, the self-assembled molecular layers 114, 138, 326, 352 may include molecules having two ends spaced apart by an elongated region, at least one end including a metal-reactive moiety. The molecules may, for example, include one or more thiol groups in mutually proximate or in mutually distant locations of the molecules. Thiol groups (—SH) may dissociate a hydrogen cation to yield a metal-reactive sulfur anion moiety. The self-assembled molecular layers 114, 138, 326, 352 may electrically insulate the electrical pathway between the first and second electrical contacts 106 and 112 or 306 and 312 and between the third and fourth electrical contacts 128 and 136 or 338 and 344 until the respective pairs of electrical contacts are brought closer together by displacing parts of the corresponding self-assembled molecular layers 114, 138, 326, 352.

In an example, molecules for forming the self-assembled molecular layers 114, 138, 326, 352 may be selected having two ends spaced apart by an elongated region resulting in a selected overall molecular length. For example, molecules may be selected for forming the self-assembled molecular layers 114, 138, 326, 352 having an overall molecular length within a range of between about 0.5 nanometer and about 2 nanometers. Accordingly, a thickness of the resulting self-assembled molecular layers 114, 138, 326, 352 in directions of the corresponding arrows 116, 140, 328, 354 may likewise be within a range of between about 0.5 nanometer and about 2 nanometers. A self-assembled molecular layer 114, 138, having a thickness of at least about 0.5 nanometer in directions of the corresponding arrows 116, 140, for example, may electrically insulate the first and third electrical contacts 106 and 128 from the second and fourth electrical contacts 112 and 136, respectively, to minimize electrical conductivity through the switches 104, 124 in the switch-open state. Likewise, a self-assembled molecular layer 326, 352 having a thickness of at least about 0.5 nanometer in directions of the corresponding arrows 328, 354, for example, may electrically insulate the first and third electrical contacts 306, 338 from the second and fourth electrical contacts 312, 344, respectively, to minimize electrical conductivity through the switches 304, 334 in the switch-open state. For these reasons, the switches 104, 124, 304, 334 may not conduct a significant direct current ("DC") until the respective electrical contacts 106, 112, 128, 136, 306, 312, 338, 344 are brought closer together by deforming parts of the corresponding self-assembled molecular layers 114, 138, 326, 352. A self-assembled molecular layer 114, 138, 326, 352 having a thickness of at least about 0.5 nanometer in directions of the corresponding arrows 116, 140, 328, 354 may also facilitate a function of interrupting the electrical connection between the first and second electrical contacts 106 and 112 or 306 and 312; or between the third and fourth electrical contacts 128 and 136 or 338 and 344. A self-assembled molecular layer 114, 138, 326, 352 having a thickness of greater than about 2 nanometers in directions of the arrows 116, 140, 328, 354 for example, may in some applications hinder formation of an electrical connection between the first and second electrical contacts 106 and 112 or 306 and 312; or between the third and fourth electrical contacts 128 and 136 or 338 and 344, by placing an excessive thickness of a self-assembled molecular layer 114, 138, 326, 352 between the respective electrical contacts that may not be adequately displaceable to result in current transmission.

The dielectric layer 314 may be formed of a composition suitable for making a flexible, deformable dielectric layer, to facilitate movement of the moveable regions 310, 342. As an example, a polymerizeable composition suitable for forming a porous layer may be utilized. In a further example, the apparatus 300 may be selected to include a dielectric layer 314 having one or more pores 318 communicating with surfaces 320, 322, 348, 350 of the dielectric layer 314. For example, each of a plurality or matrix of such pores 318 may be utilized to form a plurality or matrix of mechanical switches 304, 334. In an example, the dielectric layer 314 may be formed with a thickness in the directions of the arrows 328, 354 sufficiently large to minimize current leakage through defects in the dielectric layer 314 between the first and second electrical contacts 306, 312 or between the third and fourth electrical contacts 338, 344. As another example, the dielectric layer 314 may be formed with a thickness in the directions of the arrows 328, 354 within a range of between about 5 nanometers and about 50 nanometers.

As examples, the dielectric layer 314 may be formed of a polymer composition selected as facilitating formation of pores 318. The polymer composition may, as an example, be a copolymer composition. In an example, the dielectric layer 314 may be fabricated by supramolecular assembly of a block copolymer ("BC"). Block copolymers may form well-ordered periodic nanostructures due to immiscibility of mutually unlike polymer blocks. The nanostructural morphology may depend on the volume ratio of the blocks, while the size of the features, which may be in a range of tens of nanometers, may be mostly influenced by the length of the blocks. Four typical morphologic patterns are observed for diblock copolymers in bulk: spherical (body-centered cubic), cylindrical (hexagonal), gyroidal (bicontinuous cubic), and lamellar, depending on the ratio of block lengths and segment-segment interaction parameters. For example, the periodicity may be within a range of between about 10 nanometers and about 100 nanometers.

In an example, the dielectric layer 314 may be fabricated from a supramolecular assembly of a block copolymer including poly(styrene-block-4-vinylpyridine) ("PS-PVP") and 2-(4'-hydroxybenzeneazo)benzoic acid ("HABA"). The dielectric layer 314 as initially formed from such a block copolymer may have one phase including cylindrical nanodomains formed by PVP associated with HABA, surrounded by another phase including poly(styrene) ("PS"). As further examples, poly(methyl methacrylate) or poly(butadiene) may be substituted for poly(styrene).

The preferential wetting of the substrate 302 by one of the phases in the system including PS-PVP and HABA drives the system to an alignment of the nanodomains parallel with the surface 364 of the substrate 302. In addition, the lowest surface tension component among the phases occupies the free surfaces 320, 322 of the dielectric layer 314, enhancing a trend toward this parallel alignment, which is parallel to the arrow 336.

When formed on the substrate 302, the block copolymer dielectric layer 314 may be capable of undergoing both surface relaxation and surface reconstruction. Surface phenomena may induce changes in the periodicity and may force one of the block phases to occupy the surfaces 320, 322 of the dielectric layer 314.

The dielectric layer 314 as initially formed may include cylindrical domains oriented in the directions of the arrow 336, parallel to the surfaces 320, 322 of the dielectric layer 314. The dielectric layer 314 may consist of parallel-oriented layers of the cylinders separated by a PS matrix and may have a fingerprint-like structure. The nanocylinders of PVP plus HABA may be packed into a distorted hexagonal lattice exhibiting 31 nanometers in-plane periodicity and 17 nanometers vertical periodicity in the directions of the arrows 328, 354. In both cases a thin wetting layer (not shown) may be found between the dielectric layer 314 and the substrate 302. The surfaces 320, 322 may be enriched with PS. Alignment of the cylindrical domains in the directions of the arrows 328, 354, perpendicular to the substrate surface 364, is in contradiction with a tendency of the domains to align parallel to the confining surfaces 320, 322 of the dielectric layer 314 due to preferential wetting of the interface between the dielectric layer 314 and the substrate 302 by one of the block phases.

Alignment of the domains may be switched from the perpendicular to parallel orientation and vice versa. Swelling of the dielectric layer 314 in 1,4-dioxane may lead the system to conversion from the cylindrical to the spherical morphology. Solvent evaporation may result in shrinkage of the copolymer in the perpendicular direction and subsequent merging of the spheres into the perpendicularly aligned cylinders. The cylinders may form a regular hexagonal lattice with a spatial period of 25.5 nanometers. Vapors of chloroform may induce in-plane alignment. Fast solvent evaporation may induce the perpendicular alignment of minor block cylinders with respect to the substrate surface 364, while slow evaporation may result in parallel alignment due to the preferential wetting.

Extraction of HABA with a selective solvent may result in a dielectric layer 314 having a hexagonal lattice (24 nanometers in the period) of holes 318 having a diameter of 8 nanometers crossing the dielectric layer 314 in directions of the arrows 328, 354. The walls of the holes 318 may include reactive PVP chains.

The block copolymer dielectric layer 314 may be annealed at a temperature above its glass-transition (Tg), resulting in the formation of a thermodynamically stable or metastable state and in an increase in lateral order. As another example, annealing of the dielectric film 314 in an external electric field of a high strength (at least 30 kilovolts per centimeter) may re-orient the domains perpendicular to the film surfaces.

As a further example, a minor component forming nanodomains may be eliminated to transform the block copolymer dielectric layer 314 into a layer having holes 318. Techniques including ultraviolet etching and plasma etching may be utilized. As another approach, 4-vinylpyridine (PVP) and 3-pentadecyl phenol monomers may be included in a polymerizeable composition forming poly(styrene-block-4-vinylpyridine) (PS-PVP), into which the 4-vinylpyridine may be retained by hydrogen bonding. The supramolecular assembling of PVP and PDP may change the block copolymer morphology from spherical to cylindrical. The PDP may be removed by washing the copolymer with a selective solvent, providing nanoscopic holes 318 in the major component matrix.

Further background information on processes that may be utilized in formation of the dielectric layer 314 is disclosed in "Ordered Reactive Nanomembranes/Nanotemplates from Thin Films of Block Copolymer Supramolecular Assembly," Alexander Sydorenko, Igor Tokarev, Sergiy Minko, and Manfred Stamm, *J. Am. Chem. Soc.,* 125 (40), 12211-12216, 2003; and in "Microphase Separation in Thin Films of Poly (styrene-block-4-vinylpyridine) Copolymer-2-(4'-Hydroxybenzeneazo)benzoic Acid Assembly," Igor Tokarev, Radim Krenek, Yevgen Burkov, Dieter Schmeisser, Alexander Sydorenko, Sergiy Minko, and Manfred Stamm, *Macromolecules,* 38 (2), 507-516, 2005; and in Australian Published Patent Application No. AU 2003239762 A1, filed May 26, 2003 and published Dec. 19, 2003, titled "Method for Producing Nanostructured Surfaces and Thin Films", by Sergiy Minko, Manfred Stamm, Oleksandr Sydorenko, and Igor Tokarev, claiming priority of German patent application No. 102 25 313.7 filed Jun. 3, 2002; and related to PCT Published Patent Application No. WO 03/101628 A1 published Dec. 11, 2003, the entireties of all of which are incorporated into this specification by reference.

As another example, a pore-sized particle of a dry reagent having selective affinity for such a monomer or for another part of the polymer composition may be applied to the second surface 322, 350 and allowed to bore a pore 318 through the dielectric layer 314. In another example, the apparatus 300 may be selected to include a dielectric layer 314 that may be covalently bonded to a substrate 302.

The electrical contacts 106, 112, 118, 128, 136, 142, 306, 312, 330, 338, 344, 356 may be fabricated, as an example, by vapor deposition through shadow masks. Penetration of vapor such as metal vapor during formation of the electrical contacts 112, 136, 312, 344 into the respective self-assembled molecular layers 114, 138, 326, 352 may be dependent on a chemical composition of the selected vapor. Penetration of the selected vapor into the self-assembled molecular layers 114, 138, 326, 352 may be minimized by selecting molecules for forming the self-assembled molecular layers 114, 138, 326, 352 having two ends spaced apart by a relatively long elongated region, or by selecting molecules that pack relatively closely together forming a relatively dense structure that may minimize penetration of the vapor. Electrically-conducting fillings 324 may be filled into holes 318, for example, by electrochemical deposition. Self-assembled molecular layers 114, 138, 326, 352 may be formed, for example, by deposition of selected molecules from solution. Supports 108, 132, 308, 340 may be formed, for example, by vapor deposition and etching techniques.

Figure 5:
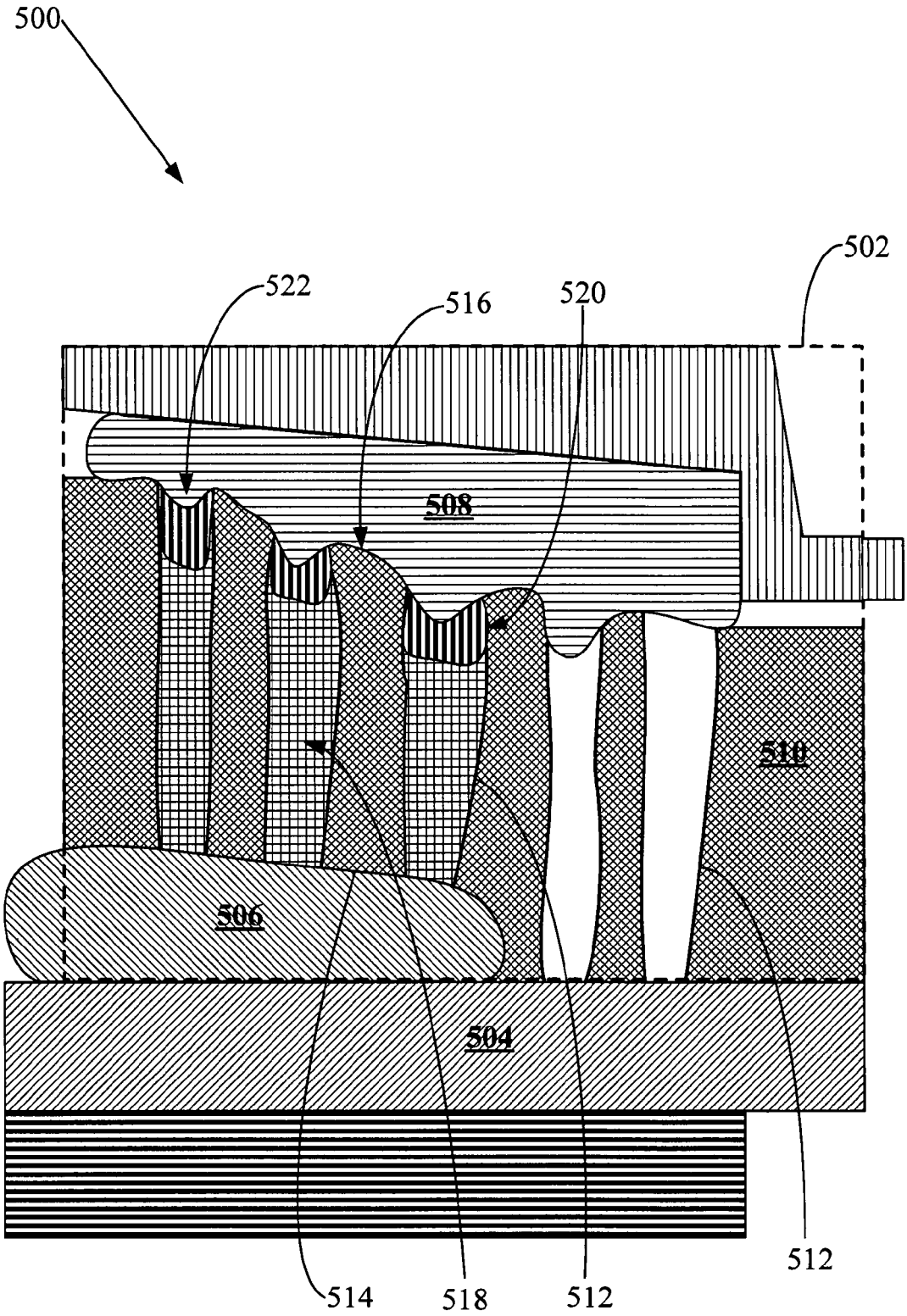
FIG. 5 is a cross-sectional side view showing an example of part of an apparatus as shown in FIG. 3, including a mechanical switch.

FIG. 5 is a cross-sectional side view showing an example 500 of part of an apparatus 300 as shown in FIG. 3, including a mechanical switch 502 located over a substrate 504. The mechanical switch 502 includes a first electrical contact 506 over the substrate 504. The mechanical switch 502 further includes a second electrical contact 508. The second electrical contact 508 is located over the first electrical contact 506. The apparatus additionally includes a dielectric layer 510. The dielectric layer 510 has a plurality of holes 512 aligned between the first and second electrical contacts 506, 508. As an example, the dielectric layer 510 may have a first surface 514 facing the first electrical contact 506, a second surface 516 facing the second electrical contact 508, and a plurality of holes 512 interposed between the first and second electrical contacts 506, 508 and communicating between the first and second surfaces 514, 516. As examples, the holes may be pores 512. As a further example, a pore 512 may have an electrically-conductive filling 518. An electrically-conductive filling 518 may include, for example, particles having a composition including one or more metals or conductive polymeric compositions as discussed in connection with FIG. 3. The mechanical switch 502 additionally includes a self-assembled molecular layer 520 interposed between the first and second electrical contacts 506, 508. As an example, the self-assembled molecular layer 520 may be located in a pore 512, between the second electrical contact 508 and an electrically-conductive filling 518 also in the pore 512. The second electrical contact 508 may include, for example, bumps 522 partially intruding into pores 512 and making contact with a self-assembled molecular layer 520 in the pores 512.

As an example, the pores 512, electrically-conductive fillings 518, self-assembled molecular layers 520, and bumps 522 may be self-aligning during fabrication of the example of the apparatus 300. Such self-alignment may begin with formation, on the substrate 504, of the dielectric layer 510 including a pore 512 communicating between the first and second surfaces 514, 516. The electrically-conductive filling 518 may then be deposited from solution in the pore 512 by an electro-chemical technique. As an example, the electrically-conductive filling 518 may only partially fill the pore 512. The self-assembled molecular layer 520 may then be deposited from a solution dipping technique onto the electrically-conductive filling 518 in the pore 512. For example, thiol-terminated reagents for forming the self-assembled molecular layer 520 may be selectively bonded onto the electrically-conductive filling 518. The second electrical contact 508 including bumps 522 making contact with the self-assembled molecular layer 520 may then be formed over the dielectric layer 510 by shadow masking, vapor deposition, and etching techniques. The self-assembled molecular layer 520 may facilitate formation of the bumps 522 at locations spaced apart from the electrically-conductive filling 518 so that the mechanical switch 502 as fabricated is in a switch-open state. A density of molecules included in the self-assembled molecular layer 520 may be sufficiently high to minimize penetration into the self-assembled molecular layer 520 of vapor for formation of the second electrical contact 508. In another example, features of the apparatus 100 discussed above in connection with FIGS. 1-2 or of the apparatus 300 discussed above in connection with FIGS. 3-4 may be included in the apparatus 500. The entireties of the discussions above of the apparatus 100, 300 and of the materials and processes for fabrication of such apparatus are incorporated in this discussion of the apparatus 500.

Figure 6:
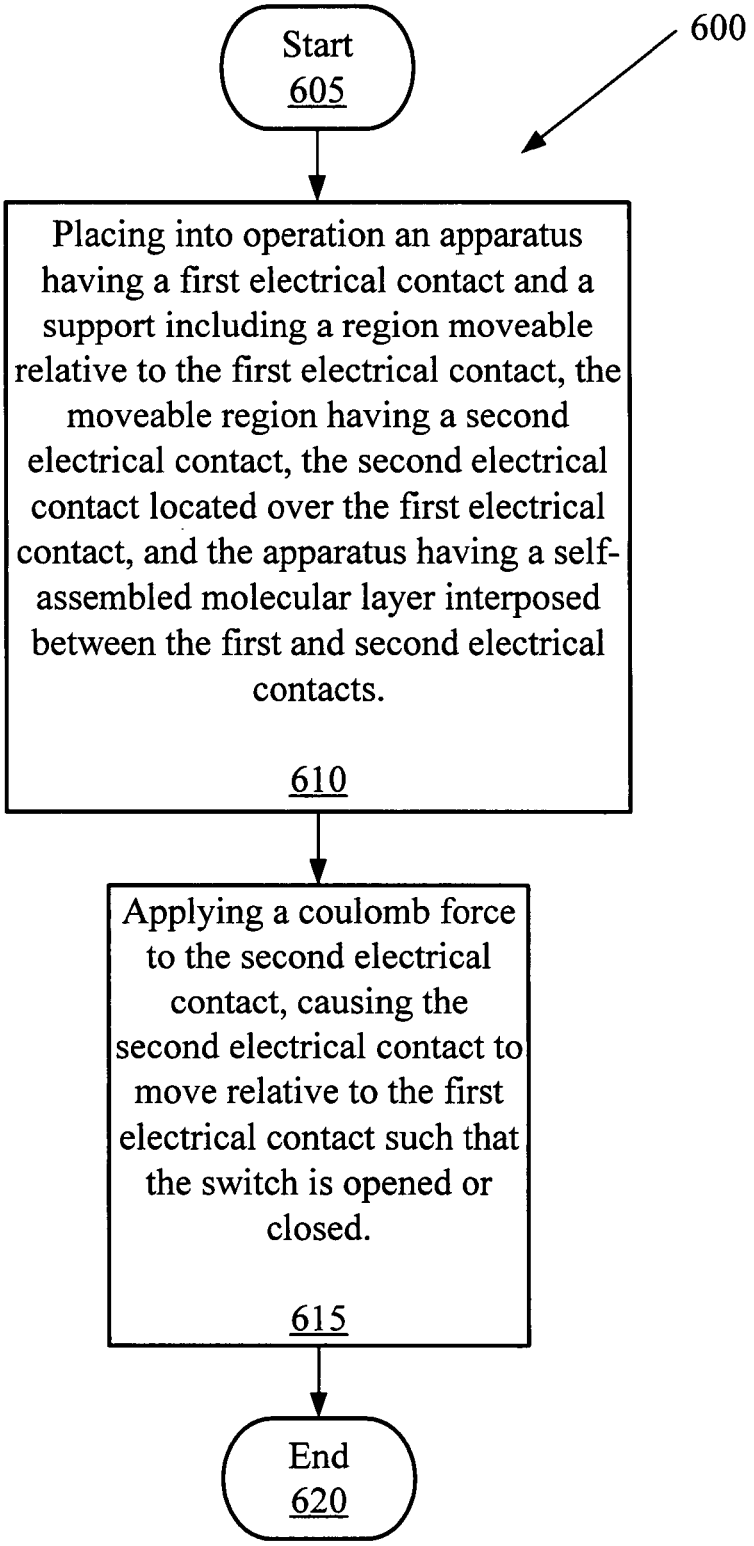
FIG. 6 is a flow chart showing an example of an implementation of a method.

FIG. 6 is a flow chart showing an example of an implementation of a method 600. The method starts at step 605, and at step 610 an apparatus is placed into operation having a first electrical contact and a support including a region moveable relative to the first electrical contact, the moveable region having a second electrical contact, the second electrical contact located over the first electrical contact, and the apparatus having a self-assembled molecular layer interposed between the first and second electrical contacts. In an example, the support may include an arm. The apparatus 100, 300, 500 discussed above, as examples, may be utilized. The entireties of the discussions above of the apparatus 100, 300, 500 in connection with FIGS. 1-5 are incorporated in this discussion of the method 600. Placing the apparatus into operation at step 610 may, for example, include fabricating the apparatus, or the apparatus may be pre-fabricated. In step 615, a coulomb force is applied to the second electrical contact, causing the second electrical contact to move relative to the first electrical contact such that the switch is opened or closed. The method 600 may then end at step 620.

In the following further examples, placing an apparatus into operation in step 610 may include placing into operation an apparatus having additional features; and step 615 may also be accordingly modified. Step 610 may include placing into operation an apparatus having a moveable region locating the second electrical contact at a position spaced apart from the first electrical contact, and applying a coulomb force in step 615 may include causing the second electrical contact in the moveable region to move toward the first electrical contact. Also, step 610 may include placing into operation an apparatus having a self-assembled molecular layer including a molecule having two ends spaced apart by an elongated region, an end including a metal-reactive moiety. Step 610 may include placing into operation an apparatus having a third electrical contact and a second support including a second region moveable relative to the third electrical contact, the second moveable region having a fourth electrical contact, the fourth electrical contact located over the third electrical contact, and the apparatus having a self-assembled molecular layer interposed between the third and fourth electrical contacts. Additionally, step 610 may include placing into operation an apparatus having a dielectric layer, a part of the dielectric layer being interposed between the substrate and the support, the dielectric layer having a hole aligned between the first and second electrical contacts. Step 610 may, in addition, include placing into operation an apparatus having a dielectric layer including a first surface facing the first electrical contact, a second surface facing the second electrical contact, and a pore interposed between the first and second electrical contacts and communicating between the first and second surfaces. Placing an apparatus into operation in step 610 may also include utilizing an apparatus having a pore including an electrically-conductive filling. Further, step 610 may include placing into operation an apparatus having a pore including an electrically-conductive filling that includes particles having a composition including a metal.

The apparatus 100, 300, 500 may, for example, be utilized as components of an integrated circuit (not shown) or of a micro-electronic-mechanical system ("MEMS") (not shown), or of a semiconductor device (not shown), or of a sensor (not shown), or of a filter (not shown), or of another electronic circuit (not shown). As examples, "semiconductor devices" include transistors and diodes. Likewise, the method 600 may be utilized in diverse end-use applications for closing and interrupting current in an integrated circuit, MEMS, semiconductor device, sensor, filter, or other electronic circuit. While the foregoing description refers in some instances to the apparatus 100, 300, 500 and the method 600 as shown in FIGS. 1-6, it is appreciated that the subject matter is not limited to these structures, nor to the structures discussed in the specification. Other shapes and configurations of apparatus may be fabricated. Likewise, the method 600 may be performed utilizing any apparatus placed into operation in step 610, of which the apparatus 100, 300, 500 are examples. Further, it is understood by those skilled in the art that the method 600 may include additional steps and modifications of the indicated steps.

Moreover, it will be understood that the foregoing description of numerous examples has been presented for purposes of illustration and description. This description is not exhaustive and does not limit the claimed invention to the precise forms disclosed. Modifications and variations are possible in light of the above description or may be acquired from practicing the invention. The claims and their equivalents define the scope of the invention.

What is claimed is:

1. An apparatus comprising a substrate and a mechanical switch, the mechanical switch located over the substrate, the mechanical switch including:

a first electrical contact over the substrate;

a support over the substrate, the support including a region moveable relative to the first electrical contact, the moveable region having a second electrical contact, the second electrical contact located over the first electrical contact; and a self-assembled molecular layer between the substrate and the second electrical contact.

2. The apparatus of claim 1, where the first and second electrical contacts are configured to together form a controllable electrical pathway in an electrical circuit.

3. The apparatus of claim 1, where the mechanical switch includes an electrical contact configured to apply a coulomb force capable of moving the second electrical contact relative to the first electrical contact, the relative movement capable of opening and closing the switch.

4. The apparatus of claim 1, where the support includes a flexible region.

5. The apparatus of claim 1, where the moveable region locates the second electrical contact at a position spaced apart from the first electrical contact in an open state of the mechanical switch.

6. The apparatus of claim 1, where the self-assembled molecular layer includes a plurality of molecules, each of a plurality of molecules having first and second ends spaced apart by an elongated region, an end including a metal-reactive moiety.

7. The apparatus of claim 1 including a second mechanical switch located over the substrate, the second mechanical switch including:

a third electrical contact over the substrate;

a second support over the substrate, the second support including a second region moveable relative to the third electrical contact, the second moveable region having a fourth electrical contact, the fourth electrical contact located over the third electrical contact; and a self-assembled molecular layer interposed between the substrate and the fourth electrical contact.

8. The apparatus of claim 1, including a dielectric layer, a part of the dielectric layer interposed between the substrate and the support, the dielectric layer having a hole aligned between the first and second electrical contacts.

9. The apparatus of claim 8, where the dielectric layer has a first surface facing the first electrical contact, a second surface facing the second electrical contact, and a pore interposed between the first and second electrical contacts and communicating between the first and second surfaces.

10. The apparatus of claim 9, including a pore having an electrically-conductive filling.

11. The apparatus of claim 10, where the electrically-conductive filling includes particles having a composition including a metal.

12. The apparatus of claim 10, where the self-assembled molecular layer is interposed between the electrically-conductive filling and the fourth electrical contact.

13. A method comprising:

placing into operation an apparatus having a first electrical contact and a support including a region moveable relative to the first electrical contact, the moveable region having a second electrical contact, the second electrical contact located over the first electrical contact, and the apparatus having a self-assembled molecular layer interposed between the first and second electrical contacts; and applying a coulomb force causing the second electrical contact to move relative to the first electrical contact such that the switch is opened or closed.

14. The method of claim 13, where placing an apparatus into operation includes utilizing an apparatus having a moveable region locating the second electrical contact at a position spaced apart from the first electrical contact, and where applying a coulomb force includes causing the second electrical contact in the moveable region to move toward the first electrical contact such that the switch is closed.

15. The method of claim 13, where placing an apparatus into operation includes utilizing an apparatus having a self-assembled molecular layer including a molecule having two ends spaced apart by an elongated region, an end including a metal-reactive moiety.

16. The method of claim 13, where placing an apparatus into operation includes utilizing an apparatus having a third electrical contact and a second support including a second region moveable relative to the third electrical contact, the second moveable region having a fourth electrical contact, the fourth electrical contact located over the third electrical contact, and the apparatus having a self-assembled molecular layer interposed between the third and fourth electrical contacts.

17. The method of claim 13, where placing an apparatus into operation includes utilizing an apparatus having a dielectric layer, a part of the dielectric layer being interposed between the substrate and the support, the dielectric layer having a hole aligned between the first and second electrical contacts.

18. The method of claim 17, where placing an apparatus into operation includes utilizing an apparatus having a dielectric layer including a first surface facing the first electrical contact, a second surface facing the second electrical contact, and a pore interposed between the first and second electrical contacts and communicating between the first and second surfaces.

19. The method of claim 18, where placing an apparatus into operation includes utilizing an apparatus having a pore including an electrically-conductive filling.

20. The method of claim 19, where placing an apparatus into operation includes utilizing an apparatus having a pore including an electrically-conductive filling that includes particles having a composition including a metal.

* * * * *